US007117842B2

(12) United States Patent
Boehland et al.

(10) Patent No.: US 7,117,842 B2
(45) Date of Patent: Oct. 10, 2006

(54) FUEL INJECTION VALVE FOR INTERNAL COMBUSTION ENGINES

(75) Inventors: Peter Boehland, Marbach (DE); Sebatian Kanne, Stuttgart (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 411 days.

(21) Appl. No.: 10/332,375

(22) PCT Filed: Mar. 22, 2002

(86) PCT No.: PCT/DE02/01036

§ 371 (c)(1),
(2), (4) Date: Oct. 1, 2003

(87) PCT Pub. No.: WO02/090754

PCT Pub. Date: Nov. 14, 2002

(65) Prior Publication Data

US 2005/0199753 A1 Sep. 15, 2005

(30) Foreign Application Priority Data

May 8, 2001 (DE) ..... 101 22 241

(51) Int. Cl.
*F02B 3/00* (2006.01)
*F02B 3/10* (2006.01)

(52) U.S. Cl. ..... 123/299; 123/467

(58) Field of Classification Search ..... 123/299, 123/305, 467, 468, 506, 446; 239/533.1, 239/533.2, 533.8, 533.12, 562, 564
See application file for complete search history.

(56) References Cited

U.S. PATENT DOCUMENTS

| | | | | |
|---|---|---|---|---|
| 6,378,503 | B1 * | 4/2002 | Lambert | 123/468 |
| 6,810,857 | B1 * | 11/2004 | Boehland et al. | 123/467 |
| 2005/0172935 | A1 * | 8/2005 | Magel et al. | 123/446 |
| 2005/0274828 | A1 * | 12/2005 | Kurz et al. | 239/533.2 |

* cited by examiner

*Primary Examiner*—Mahmoud Gimie
(74) *Attorney, Agent, or Firm*—Ronald E. Greigg

(57) ABSTRACT

A fuel injection valve in which a pistonlike outer valve needle is disposed longitudinally displaceably in a bore and cooperates with a valve seat to control at least one injection opening. A control chamber regulatable by a valve is provided and pressure in the control chamber exerts a closing force at least indirectly on the outer valve needle in the direction of the valve seat. A pressure face embodied on the outer valve needle is acted upon by the pressure in a pressure chamber, which is embodied between the outer valve needle and the wall of the bore and extends as far as the valve seat, so that an opening force on the outer valve needle results that is oriented counter to the closing force. An inner valve needle is guided in the outer valve needle and controls at least one additional injection opening and is acted upon by the pressure in the control chamber at least indirectly in the direction of the valve seat.

12 Claims, 4 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 02/01036 filed on Mar. 22, 2002.

BACKGROUND OF THE INVENTION

1. Field of the Invention

To reduce emissions and increase the efficiency of internal combustion engines with direct fuel injection, one goal is to inject the fuel into the combustion chamber of the engine in as finely-atomized a form as possible. To that end, first the injection pressure at which the fuel is injected through the fuel injection valve is increased. Second, the number of injection ports of the fuel injection valve is increased, so that the diameter of the individual injection ports can be reduced. The goal of this provision is to increase the energy of injection streams while at the same time reducing the droplet diameter. If very small quantities are to be fed, then when the pressures at the fuel injection valve are high the injection times are quite short. The course of combustion is consequently powerful and correspondingly noisy.

2. Description of the Prior Art

From European Patent Application EP 0 470 348 A1, for instance, a fuel injection valve of variable injection cross section is known, in which two rows of injection openings are embodied. These injection openings are controlled by an inner valve needle and a tube surrounding the valve needle; both the tube and the inner needle are acted on by closing springs, which press them into contact with a valve seat, as a result of which the injection openings are closed. If fuel at high pressure is introduced into corresponding pressure chambers, then the tube and the inner needle are acted upon by the fuel pressure in these pressure chambers. Depending on the pressure of the fuel introduced, either only the inner needle lifts from the valve seat and uncovers the first row of injection openings, or the inner needle and tube lift up from the valve seat successively, so that both rows of injection openings are opened in succession. The opening of the inner needle and the tube is accordingly pressure-controlled, so that the successive opening of the inner needle and the outer tube is achieved by means of a skillful design of the pressure faces and of the force of the closing springs.

Stroke-controlled fuel injection systems are also known from the prior art, in which a valve needle has a pressure face that is constantly urged in the opening direction by fuel at high pressure. The contrary force is generated not by a closing spring but rather hydraulically by a valve piston, which acts on the valve needle and in turn, because of the fuel pressure in a control chamber, exerts a closing force on the valve needle. As an example here, German Patent Disclosure DE 198 27 267 A1 can be named. By varying the fuel pressure in the control chamber, the closing force on the valve needle is changed, so that this needle is moved against the pressure face by the hydraulic force. Such stroke-controlled fuel injection systems are used in many modern internal combustion engines, especially for self-igniting engines in passenger cars.

A combination of the two systems, that is, of the variable injection cross section and the stroke-controlled injection system, would be especially advantageous to further optimize the combustion process. Until now, however, it was not possible without major effort to adopt the variable injection cross section to the stroke-controlled systems without making further modifications. Doing so requires complicated sealing edges or additional control valves, which are complicated to manufacture and expensive.

SUMMARY OF THE INVENTION

The fuel injection valve of the invention has the advantage over the prior art that with a stroke-controlled injection system, two rows of injection openings can be opened successively, and a shaping of the course of injection is thus possible without requiring additional control edges or control valves. An inner valve needle is guided in the outer valve needle, and each controlls at least one injection opening. In the fuel injection valve, a fuel-filled control chamber is embodied, by whose pressure the valve needles are urged at least indirectly in the direction of the valve seat. If the pressure in the control chamber changes, then the closing force exerted by the valve needles also changes, so that triggering of the injection openings is possible.

In an advantageous feature of the invention, a throttle connection is formed by the opening stroke motion of the outer valve needle, so that the inner valve needle is no longer acted upon by the pressure in the control chamber. As a result, the closing force on the inner valve needle is reduced in a simple way, without requiring a control edge or an additional valve.

In an advantageous feature, the outer valve needle is connected to an outer piston rod, whose end face is acted upon by the pressure in the control chamber and thereby generates the closing force on the valve needle. As a result, the function of the valve needle and of the pressure-actuated piston rod can advantageously be separated from one another and thus each designed optimally.

In a further advantageous feature, the throttle connection is formed between the face end of the piston rod and a stationary bottom face, so that the throttle connection can be embodied in a simple way that is accordingly easy to manufacture.

In another advantageous feature, the inner valve needle is also connected to an inner piston rod, whose face end is likewise acted upon by the pressure in the pressure chamber and thus generates the closing force on the inner valve needle. By this means as well, the function of the valve needle and of the piston rod can be separated.

In still another advantageous feature, the inner piston rod is guided in the outer piston rod, so that both piston rods are coaxial to one another. As a result, the connection of the outer piston rod to the outer valve needle, and of the inner valve needle to the inner piston rod, can advantageously be achieved in a simple way.

In a further advantageous feature, the inner piston rod, in the opening stroke motion of the inner valve needle, comes to rest on a stop face embodied on the inside of the outer piston rod. As a result, the stroke stop of the inner valve needle is realized in a simple way, without having to embody a stroke stop on the housing of the fuel injection valve.

In still another advantageous feature, the outer piston rod, on its end remote from the combustion chamber, has an inward-projecting region. As a result, an inner control chamber is defined by the outer valve needle, the inward-projecting region, and the inner valve needle, and this inner control chamber communicates with the control chamber, the communication being embodied in the form of a connecting bore. As a result, the pressure equalization between the control chamber and the inner control chamber and thus the closing force on the inner valve needle in the opening stroke motion can be adapted by means of the design of the valve needle, so that a defined, successive opening of the outer valve needle and the inner valve needle takes place, and thus the desired shaping of the injection course takes place as well.

In still another advantageous feature of the invention, the inner valve needle has a pressure face, which is not acted upon by the pressure in the pressure chamber until after the outer valve needle has lifted from the valve seat. As a result, an opening force on the inner valve needle is produced only when an injection is to occur. Because of this, no opening force acts on the inner valve needle between injections, and this needle always securely closes the injection openings assigned to it.

In still another advantageous feature of the invention, the pressure in the control chamber is established by a communication, controllable by a valve, with a leak fuel chamber. Thus for controlling the pressure, only this one 2/2-port directional control valve is required, since the inner throttle remains unchanged.

In another advantageous feature of the invention, the outer piston rod, in the opening stroke motion of the outer valve needle, closes the inner throttle at least partly. The result is a further drop in the pressure in the control chamber, so that the closing force on the inner valve needle decreases further. By means of a suitable design of the opening forces on the valve needles, it can be attained that the inner valve needle executes an opening stroke motion only after the outer valve needle has closed the inner throttle, and thus the injection openings are opened successively. In this way, the injection rate at the onset of the injection is less than during the main injection, in which all the injection openings are uncovered, so that a shaping of the injection course is achieved.

BRIEF DESCRIPTION OF THE DRAWINGS

Further advantages and advantageous features of the subject of the invention can be learned from the description contained below, with reference to the drawings, in which.

DESCRIPTION OF THE PREFERRED EMBODIMENT

Figure 1:
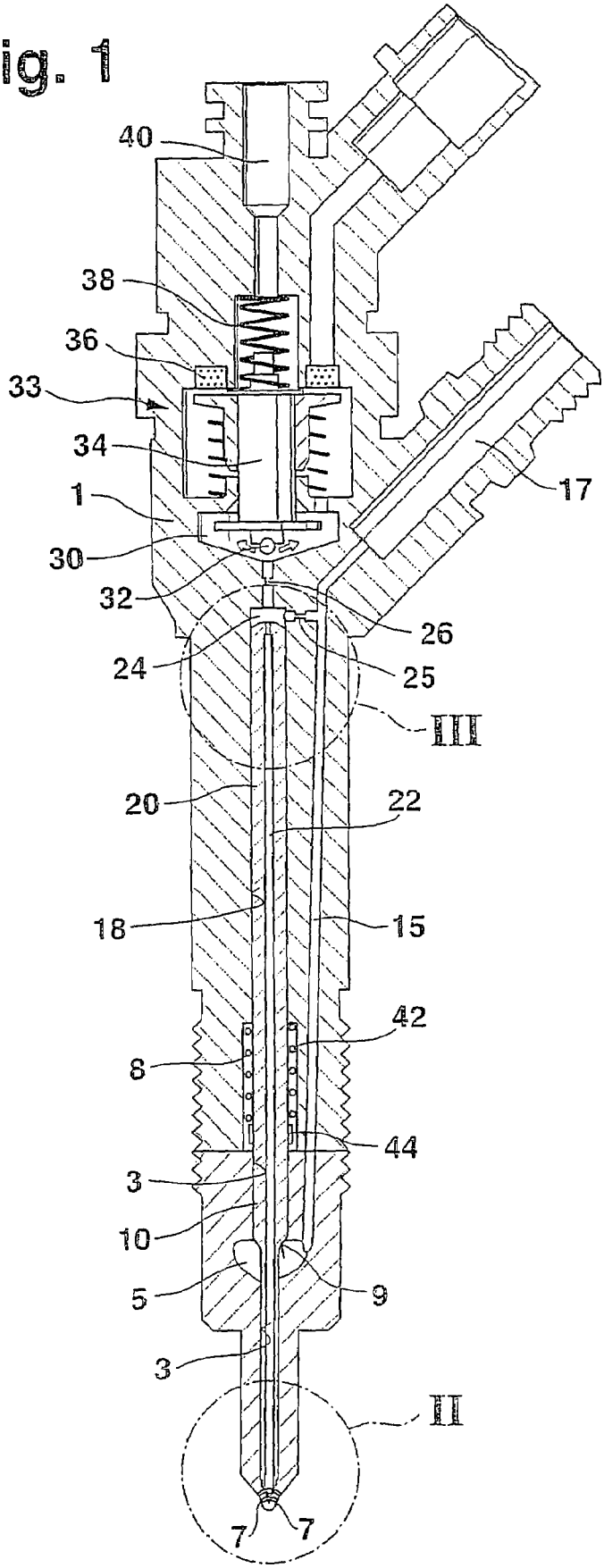
FIG. 1 shows a longitudinal section through a fuel injection valve of the invention.
Figure 2:
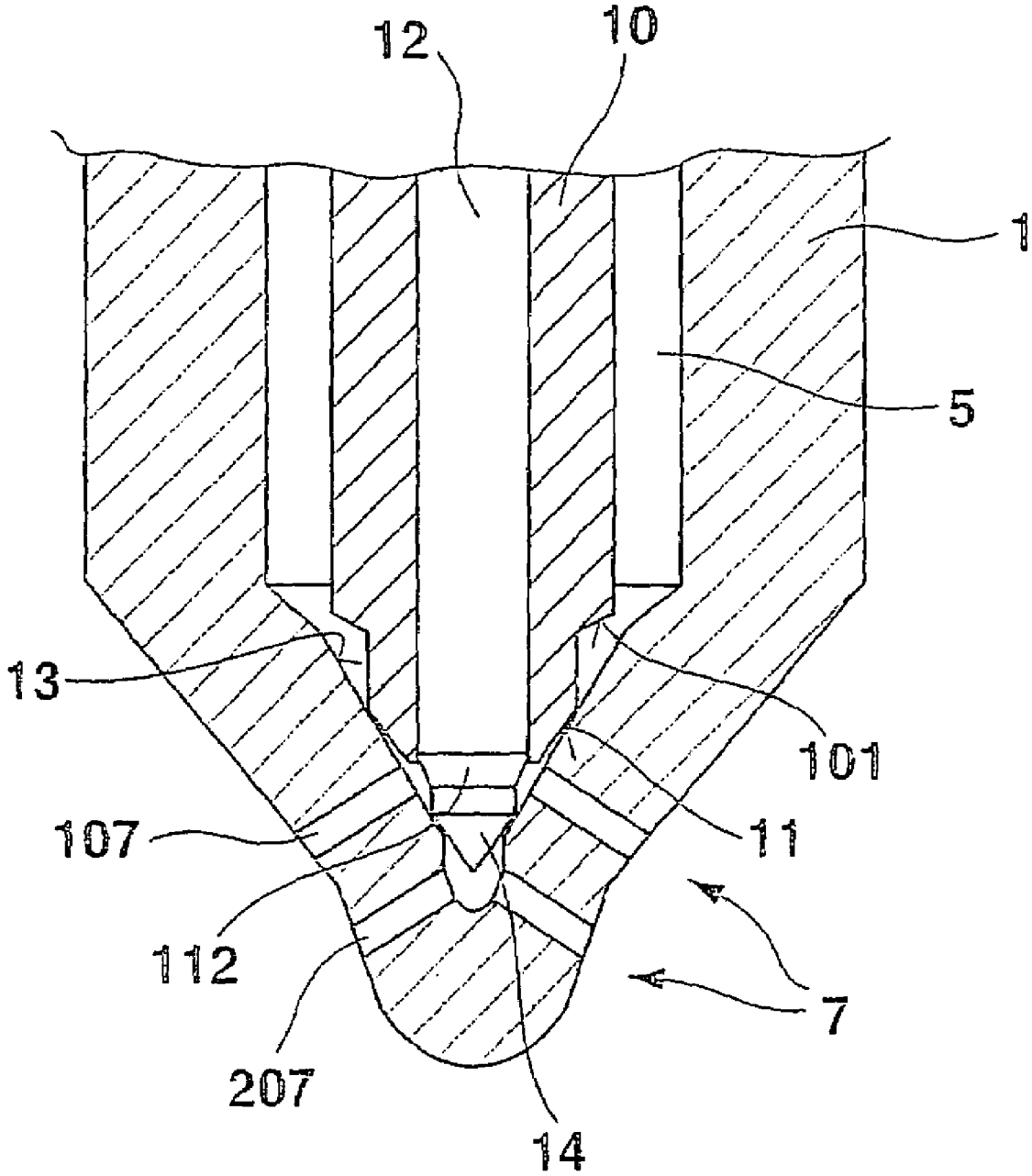
FIG. 2 shows an enlargement of FIG. 1 in the region marked II.

In FIG. 1, one exemplary embodiment of the fuel injection valve of the invention is shown in longitudinal section. The fuel injection valve includes a housing 1, which can be constructed in multiple parts. On its end region toward the combustion chamber, the housing 1 has a bore 3, in which a pistonlike outer valve needle 10 is disposed. The outer valve needle 10 is guided sealingly in the bore 3 in a portion remote from the combustion chamber and tapers toward the combustion chamber, forming a pressure shoulder 9. On the end toward the combustion chamber, the outer valve needle 10 changes into a conical pressure face 101 (FIG. 2) and finally into a likewise conical valve sealing face 11; the pressure face 11, in the closing position of the outer valve needle 10, comes to rest on a valve seat 13 embodied on the end of the bore 3 toward the combustion chamber. In FIG. 2, an enlarged view of the detail marked II of FIG. 1 is shown, in the region of the valve seat 13. By means of a radial enlargement of the bore 3, a pressure chamber 5 is formed in the housing 1 at the level of the pressure shoulder 9, and this chamber continues in the form of an annular conduit, surrounding the outer valve needle 10, as far as the valve seat 13. A plurality of injection openings 7 are embodied in the valve seat 13, arranged in a first row 107 of injection openings and a second row 207 of injection openings, disposed axially offset from it. Upon contact of the outer valve needle 10 with the valve seat 13, this valve needle closes all the injection openings 7 off from the pressure chamber 5, SO that no fuel from the pressure chamber can reach the injection openings 7.

In the outer valve needle 10, there is an inner valve needle 12, which is pistonlike and which on its end toward the combustion chamber has a conical pressure face 112 and a valve sealing face 14. If the inner valve needle 12 comes into contact with the valve seat 13, then the valve sealing face 14 touches the valve seat 13 between the first row 107 of injection openings and the second row 207 of injection openings. By the interplay of the outer valve needle 10 and the inner valve needle 12, the rows 107, 207 of injection openings can be made to communicate with the pressure chamber 5. If the outer valve needle 10 with its valve sealing face 11 is resting on the valve seat 13, then both rows 107, 207 of injection openings are closed off from the pressure chamber 5. If only the outer valve needle 10 lifts from the valve seat 13, while the inner valve needle 12 with its valve sealing face 14 rests on the valve seat 13, then only the first row 107 of injection openings is made to communicate with the pressure chamber 5, while the second row 207 of injection openings remains closed by the inner valve needle 12. Not until the inner valve needle 12 also lifts from the valve seat 13 is the second row 207 of injection openings made to communicate with the pressure chamber 5.

Via an inlet conduit 15 extending in the housing 1, the pressure chamber 5 communicates with a high-pressure connection 17, which communicates with a high-pressure fuel source, not shown in the drawing. When the internal combustion engine is in operation, the high-pressure fuel source here furnishes a predetermined high fuel pressure, so that in the inlet conduit 15 and thus also in the pressure chamber 5, this fuel pressure always prevails and forms a high-pressure fuel region.

Remote from the combustion chamber toward the bore 3, a piston bore 18 embodied as a blind bore is made in the housing 1; it has a bottom or end face 19. An outer piston rod 20 is disposed longitudinally displaceably in the piston bore 18 and rests, with its face toward the combustion chamber, on the outer valve needle 10 and, with its face end 21 remote from the combustion chamber, it defines a control chamber 24 embodied on the end of the piston bore 18. By means of a radial enlargement of the piston bore 18, a spring chamber 8 is embodied in the housing 1, in the end region of the piston rod 20 toward the combustion chamber, and a compression spring 42 is disposed with pressure prestressing in this spring chamber. The spring 42 is braced in stationary fashion on the end remote from the combustion chamber, and on its end toward the combustion chamber it rests on a spring plate 44, which is connected to the outer piston rod 20, so that the spring 42 exerts a force in the direction of the valve seat 13 on the outer piston rod 20 and thus also on the outer valve needle 10.

Figure 3:
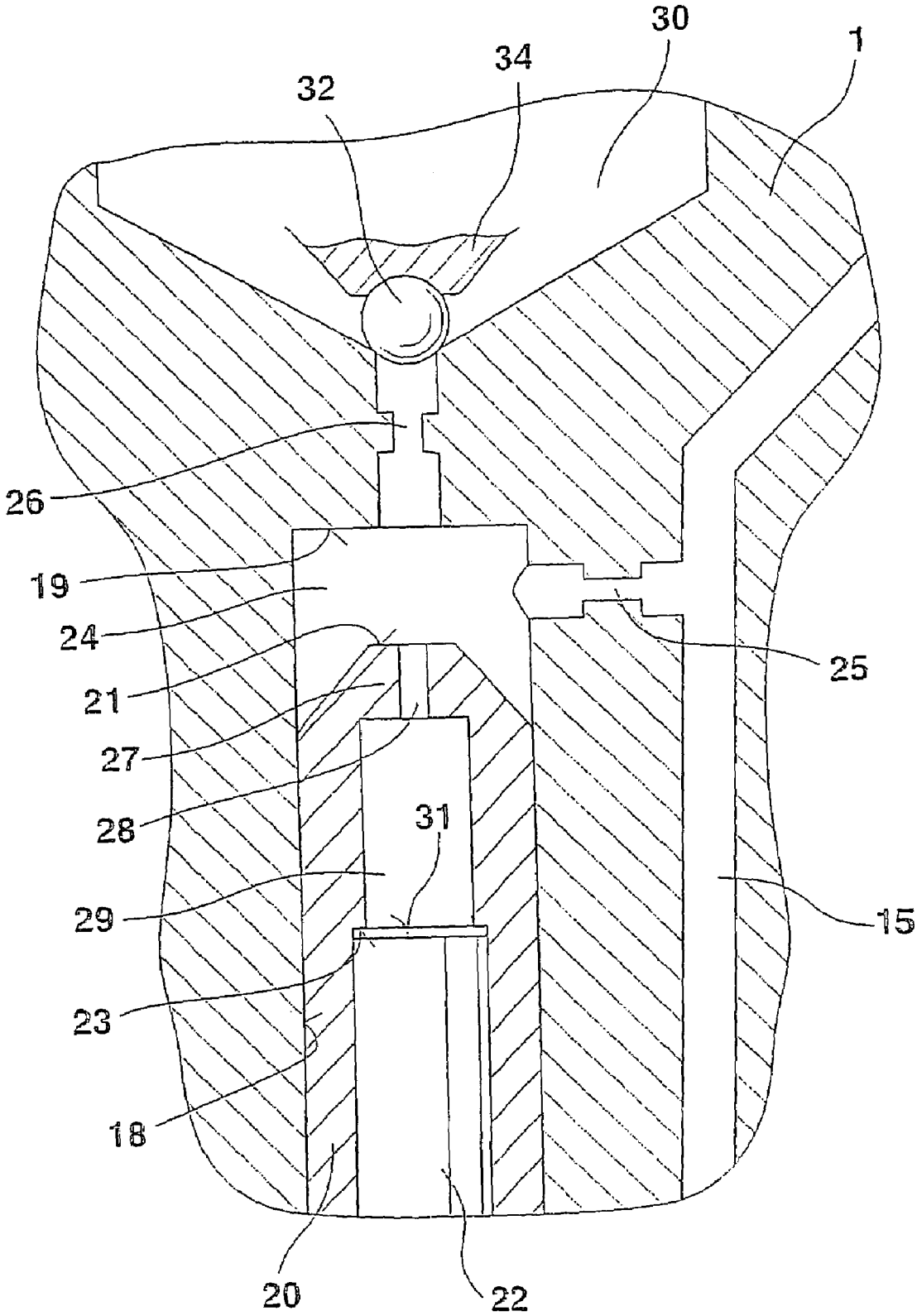
FIG. 3 shows an enlargement of FIG. 1 in the region marked III.

In the outer piston rod 20, there is an inner piston rod 22, which is longitudinally displaceable in the outer piston rod 20. On its end toward the combustion chamber, the inner piston rod 22 rests on the inner valve needle 12, so that the inner piston rod 22 and the inner valve needle 12 move synchronously. FIG. 3 shows an enlargement of FIG. 1 in the region of the control chamber 24. The control chamber 24 is defined by the bottom face 19, the wall of the piston bore 18, and the face end 21 of the outer piston rod 20. The outer piston rod 20, on its end remote from the combustion chamber, has an inward-projecting region 27, so that the outer piston rod 20 and the face end 31, remote from the combustion chamber, of the inner piston rod 22 define an inner control chamber 29, which communicates with the control chamber 24 via a connecting bore 28 in the outer piston rod 20. A stop face 23 is embodied in the interior of the outer piston rod 20 and limits the longitudinal motion of the inner piston rod 22. In the closing position of the fuel injection valve, that is, when both the inner valve needle 12 and the outer valve needle 10 are resting on the valve seat 13, an axial spacing remains between the stop face 23 and the face end 31, remote from the combustion chamber, of the inner piston rod 22.

The control chamber 24 communicates with the inlet conduit 15 via an inner throttle 25. Moreover, via an outer throttle 26, the control chamber 24 communicates with a leak fuel chamber 30 embodied in the housing 1. A longitudinally movable magnet armature 34 is disposed in the leak fuel chamber 30 and has a sealing cone or ball 32 on its end toward the control chamber 24. The magnet armature 34 is acted upon by a closing spring 38, which presses the magnet armature 34 in the direction of the control chamber 24. An electromagnet 36 is also disposed in the leak fuel chamber 30; when suitably supplied with current, it exerts an attracting force on the magnet armature 34 and moves it away from the control chamber 24, counter to the force of the closing spring 38. If no current is supplied to the electromagnet 36, then the magnet armature 34 is pressed by the closing spring 38 in the direction of the control chamber 24, and the sealing cone 32 closes the outer throttle 26. When current is supplied to the electromagnet 36, the magnet armature 34 is moved away from the control chamber 24, and the sealing cone 32 uncovers the outer throttle 26. In this position, fuel can flow out of the control chamber 24 into the leak fuel chamber 30, via the outer throttle 26. The magnet armature 34, sealing cone 32, and electromagnet 36 thus form a valve 33.

The mode of operation of the fuel injection valve is as follows: In the closed state of the fuel injection valve, that is, when no fuel is injected through the injection openings 7 into the combustion chamber of the engine, the sealing cone 32 closes the outer throttle 26. Through the inner throttle 25, the same fuel pressure prevails in the control chamber 24 as in the inlet conduit 15. The result is a hydraulic force on the face end 21 of the outer piston rod 20 and on the face end 31 of the inner piston rod 22, which transmit this force to the outer valve needle 10 and the inner valve needle 12, respectively, so that the valve needles 10, 12 are pressed into contact with the valve seat 13 and close the injection openings 7. The ratio in terms of size between the face end 21 and the pressure shoulder 9, or the pressure face 101 of the outer valve needle 10, is designed such that in this state of the fuel injection valve, the hydraulic force on the face end 21 of the outer piston rod 20 predominates. If an injection of fuel into the combustion chamber is to be accomplished, current is supplied to the electromagnet 36, as a result of which the magnet armature 34 and thus also the sealing cone 32 move away from the outer throttle 26 and cause the control chamber 24 to communicate with the leak fuel chamber 30 via the outer throttle 26. The flow resistances of the inner throttle 25 and outer throttle 26 are designed such that the fuel pressure in the control chamber 24 drops as a result, in fact so far that the outer valve needle 10, because of the pressure face 101 and the pressure shoulder 9, experiences a greater hydraulic force than the hydraulic force in the control chamber 24 that now also acts on the face end 21 of the outer piston rod 20.

Figure 4:
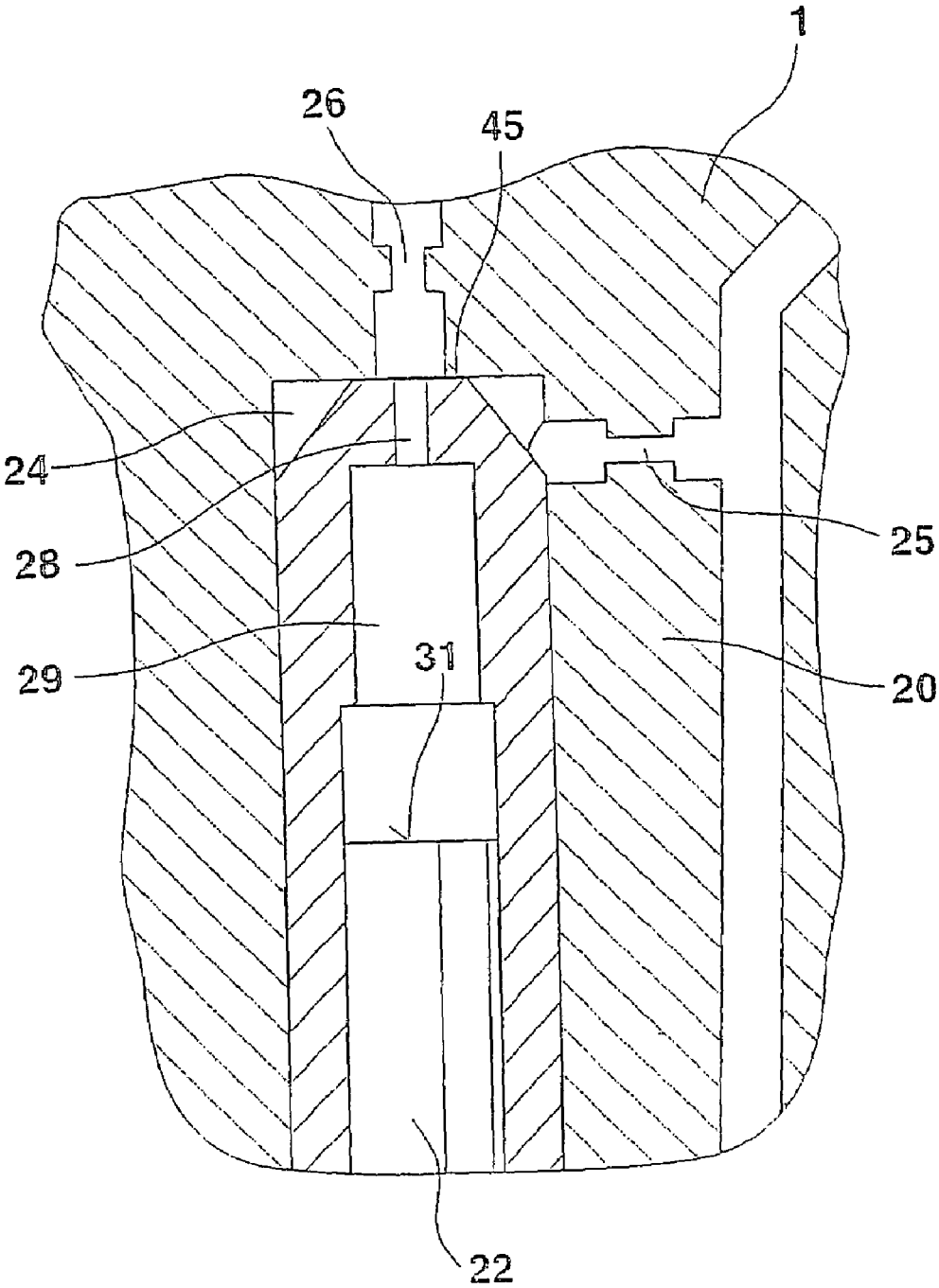
FIG. 4 shows the same detail as FIG. 3, but with the outer piston rod in a different switching position.

As soon as the outer valve needle 10 lifts from the valve seat 13, it uncovers the first row 107 of injection openings, through which fuel is now injected into the combustion chamber of the engine. As a result, the pressure face 112 of the inner valve needle 12 is now also acted upon by fuel pressure from the pressure chamber 5, so that the inner valve needle 12 experiences an opening force. The remaining fuel pressure in the control chamber 24 is so high, however, that the hydraulic force on the face end 31 of the inner piston rod 22 still suffices to keep the inner valve needle 12 in the closing position, counter to the opening force. In the course of the opening stroke motion, the outer piston rod 20 finally comes into contact with the bottom face 19, and as a result, by means of an additional throttle restriction 45 (FIG. 4) that forms between the face end 21 of the outer piston rod 20 and the bottom face 19, the control chamber 24 is largely closed off from the outer throttle 26. This position of the outer piston rod 20 is shown in FIG. 4. As a result, the further inflow of fuel from the control chamber 24 to the outer throttle 26 is reduced, and the pressure in the inner control chamber 29 drops still further. Because of the now lower hydraulic pressure in the inner control chamber 29, the inner valve needle 12, driven by the hydraulic force on the pressure face 112, and thus also the inner piston rod 22 move away from the valve seat 13, so that the second row 207 of injection openings is opened. The inner piston rod 22 moves in the axial direction in this process, until it comes into contact with the stop face 23 of the outer piston rod 20. By means of the successive opening of the two rows 107 and 207 of injection openings, a shaping of the injection course is achieved, in which at the onset of injection, fuel is injected into the combustion chamber of the engine with full pressure, but through only some of the injection openings 7, while in the main injection, it is injected through all the injection openings 7 of both rows 107 and 207 of injection openings and thus also at a higher injection rate. To terminate the injection event, the current supply to the electromagnet 36 is stopped, and the sealing cone 32 on the magnet armature 34, driven by the closing spring 38, closes the outer throttle 26, 50 that because of the replenishing fuel flowing through the inner throttle 25, the fuel pressure of the inlet conduit 15 builds up again in the control chamber 24 and presses both the outer piston rod 20 and the inner piston rod 22 in the direction of the valve seat 13, so that the inner valve needle 12 and the outer valve needle 10 are moved back into the closing position.

Provision can also be made for injecting fuel through only the first row 107 of injection openings. For that purpose, the valve 33, which is formed by the electromagnet 36, the magnet armature 34, and the sealing cone 32, is closed again before the fuel pressure in the control chamber 24 has dropped so far that the inner valve needle 12 opens. The outer throttle 26 is then already closed again before the outer piston rod 20, with its end face 21, comes to rest on the bottom face 19 of the piston bore 18. As a result, a hydraulic cushion is created between the end face 21 and the bottom face 19; it damps the opening motion of the outer piston rod 20 and prevents a pressure drop in the control chamber 24, and so the inner piston rod 22 always exerts a sufficient closing force on the inner valve needle 12.

Provision can also be made for the outer piston rod 20, in the opening stroke motion of the outer valve needle 10, to cover the inner throttle 25 partially, so that the cross section of the inner throttle 25 is reduced, but the inner throttle is not closed completely. This can be achieved for instance by means of a residual annular gap between the outer piston rod 20 and the wall of the piston bore 18. The communication of the control chamber 24 with the outer throttle 26 is assured for instance by means of radially extending grooves on the face end 21 of the outer piston rod 20. As a result, the fuel inflow into the control chamber 24 through the inner throttle 25 is reduced markedly, so that the fuel in the control chamber 24 and, via the connecting bore 28, in the inner control chamber 29 as well drops further, and the inner piston rod 22 and thus the inner valve needle 12 open in the manner described above.

The foregoing relates to preferred exemplary embodiments of the invention, it being understood that other variants and embodiments thereof are possible within the spirit and scope of the invention, the latter being defined by the appended claims.

The invention claimed is:

1. A fuel injection valve for internal combustion engines, comprising a housing (1) in which a pistonlike outer valve needle (10) is disposed longitudinally displaceably in a bore (3) and cooperates with a valve seat (13), embodied on the end of the bore (3) toward the combustion chamber, to control at least one injection opening (7), a control chamber (24) embodied in the housing (1), the pressure in the control chamber (24) being regulatable by a valve (33), and by the pressure in the control chamber (24) a closing force is exerted at least indirectly on the outer valve needle (10) in the direction of the valve seat (13), at least one pressure face (9; 101), embodied on the outer valve needle (10), which face is acted upon by the pressure in a pressure chamber (5) embodied between the outer valve needle (10) and the wall of the bore (3) and extending as far as the valve seat (13), so that an opening force on the outer valve needle (10) results that is oriented counter to the closing force, and an inner valve needle (12) guided in the outer valve needle (10) and controlling at least one additional injection opening (7) on the valve seat (13), the inner valve needle (12) being acted upon by the pressure in the control chamber (24) at least indirectly in the direction of the valve seat (13).

2. The fuel injection valve of claim 1, wherein, by the opening stroke motion of the outer valve needle (10), a throttle connection (45) is formed, whereby the inner valve needle (12) is no longer acted upon at least indirectly by the pressure in the control chamber (24).

3. The fuel injection valve of claim 2, further comprising an outer piston rod (20) connected to the outer valve needle (10) and which moves synchronously with the outer valve needle (10) and has an end face (21), oriented away from the outer valve needle (10), that is acted upon by the pressure in the control chamber (24) and thus generates the closing force on the outer valve needle (10).

4. The fuel injection valve of claim 3, wherein the throttle connection (45) is formed between the face end (21) of the outer piston rod (20) and a stationary bottom face (19).

5. The fuel injection valve of claim 3, further comprising an inner piston rod (22) connected to the inner valve needle (12) and which moves synchronously with the inner valve needle (12) and an end face (31) which is acted upon in the closing direction of the inner valve needle (12) by the pressure in the control chamber (24) and thus generates the closing force on the inner valve needle (12).

6. The fuel injection valve of claim 5, wherein the outer piston rod (20) is embodied as a tube, and the inner piston rod (22) is guided in the outer piston rod (20).

7. The fuel injection valve of claim 6, further comprising a stroke stop face (23) embodied on the inside of the outer piston rod (20), and wherein the inner piston rod (22), in the opening motion effected by the opening force on a pressure face (112) of the inner valve needle (12), comes to rest on the stop face (23).

8. The fuel injection valve of claim 6, wherein an inward-projecting region (27) is embodied on the end of the outer piston rod (20) remote from the combustion chamber, whereby by means of the inside of the outer piston rod (20), the inward-projecting region (27), and the face end (21) of the inner piston rod (22), an inner control chamber (29) is defined which communicates with the control chamber (24) only through a connecting bore (28) in the outer piston rod (20).

9. The fuel injection valve of claim 1, wherein the inner valve needle (12) the pressure face (112) is not acted upon by the pressure in the pressure chamber (5) until after the outer valve needle (10) lifts from the valve seat (13), resulting in an opening force on the inner valve needle (12).

10. A fuel injection valve for internal combustion engines, comprising a housing (1) in which a pistonlike outer valve needle (10) is disposed longitudinally displaceably in a bore (3) and cooperates with a valve seat (13), embodied on the end of the bore (3) toward the combustion chamber, to control at least one injection opening (7), a control chamber (24) embodied in the housing (1), the pressure in the control chamber (24) being regulatable by a valve (33), and by the pressure in the control chamber (24) a closing force is exerted at least indirectly on the outer valve needle (10) in the direction of the valve seat (13), at least one pressure face (9; 101), embodied on the outer valve needle (10), which face is acted upon by the pressure in a pressure chamber (5) embodied between the outer valve needle (10) and the wall of the bore (3) and extending as far as the valve seat (13), so that an opening force on the outer valve needle (10) results that is oriented counter to the closing force, and an inner valve needle (12) guided in the outer valve needle (10) and controlling at least one additional injection opening (7) on the valve seat (13), the inner valve needle (12) being acted upon by the pressure in the control chamber (24) at least indirectly in the direction of the valve seat (13), wherein the control chamber (24) communicates via an inner throttle (25) with a high-pressure fuel region and via an outer throttle (26) with a leak fuel chamber (30), in which a lower fuel pressure prevails then in the high-pressure fuel region, and the outer throttle (26) can be closed by a valve (33).

11. The fuel injection valve of claim 10, wherein the outer piston rod (20), in the opening motion of the outer valve needle (10), partly closes the inner throttle (25) and thus establishes a reduced inlet cross section from the high-pressure fuel region into the control chamber (24).

12. The fuel injection valve of claim 11, further comprising a first row (107) of injection openings and a second row (207) of injection openings, axially offset from the first row are embodied at the valve seat (13), and the second row (207) of injection openings can be closed off from the pressure chamber (5) by the inner valve needle (12), while the outer valve needle (10) is capable of closing off both the second row (207) of injection openings and the first row (107) of injection openings from the pressure chamber (5).

* * * * *